United States Patent [19]

Joseph

[11] 4,076,242

[45] Feb. 28, 1978

[54] GAME DEVICE WITH A PLAYING SURFACE OF PRESSURIZED AIR

[76] Inventor: Mark Joseph, 2400 N. Lakeview, Chicago, Ill. 60614

[21] Appl. No.: 648,092

[22] Filed: Jan. 12, 1976

[51] Int. Cl.[2] ..... A63F 9/14

[52] U.S. Cl. ..... 273/85 B; 273/85 F; 273/126 R

[58] Field of Search ..... 273/126 R, 126 A, 85 A, 273/85 B, 85 F, 85 H, 119 B, 129 F; 248/346

[56] References Cited

U.S. PATENT DOCUMENTS

| | | | |
|---|---|---|---|
| 3,056,605 | 10/1962 | Alper | 273/85 F |
| 3,722,888 | 3/1973 | Ducharme | 273/126 R |
| 3,773,325 | 11/1973 | Crossman et al. | 273/126 A |
| 3,987,581 | 10/1976 | Brown | 273/126 R |
| 3,992,009 | 11/1976 | Trbovich | 273/126 R |

FOREIGN PATENT DOCUMENTS

| | | | |
|---|---|---|---|
| 460,218 | 10/1949 | Canada | 273/85 F |
| 499,781 | 6/1930 | Germany | 273/85 F |
| 609,999 | 10/1960 | Italy | 273/85 H |
| 308,879 | 2/1969 | Sweden | 273/85 B |
| 392,351 | 9/1965 | Switzerland | 273/85 B |

*Primary Examiner*—Harland S. Skogquist
*Assistant Examiner*—Harry G. Strappello
*Attorney, Agent, or Firm*—Laff, Whitesel & Rockman

[57] ABSTRACT

A pressurized plenum or air chamber is separated by internal walls to form slots, holes or the like. The separated chambers may be either in gas pressure communication or entirely separated from each other. Game piece manipulation devices operate a controller via these slots or holes. The upper surface of the plenum is perforated to enable the pressurized air to escape and form a boundary layer of air at the playing surface. The air pressure may be controlled, at the perforations, in order to form different zones of surface friction.

12 Claims, 8 Drawing Figures

GAME DEVICE WITH A PLAYING SURFACE OF PRESSURIZED AIR

The invention relates to mechanically augmented games and more particularly to such games which use a table having a boundry layer of pressurized air to create a friction-free playing surface.

As used herein, a "boundary layer" involves a suspension means for supporting a body on a pressurized cushion of air. The term "puck" is used herein to generically identify and describe any suitable playing piece which may cooperate with such a boundry layer. Therefore, these terms are to be construed to cover any playing piece which may be used in conjunction with the game device described below.

This boundry layer form of suspension is used for many different purposes, such as for supporting a hover craft, for example. It is also used in games to support a puck or other playing piece. For example, a presently popular game places a puck on an enclosed and perforated playing surface or area having a pressurized plenum of compressed air positioned immediately below the perforated surface. As the pressurized air escapes through the perforations, the puck is at least partially supported on an almost friction-free layer of air. Therefore, when struck, the puck slides at extremely high speed, sometimes almost faster than the eye can follow.

The present pressurized air games are rather elementary, wherein the players slap at the puck, as in an ice hockey game. This lack of sophistication tends to rob the game of any real and lasting attraction, since players soon tire of a game which lacks an opportunity to develop sophisticated stradegies.

Accordingly, an object of the invention is to provide new and improved games utilizing a boundry layer of air. In greater detail, an object is to provide such games with a means for developing an advanced stradegy which may be improved upon, varied, or otherwise made more interesting. Here an object is to provide a game demanding dexterity as well as reflexes.

Another object is to provide a new family of games which use boundry layer control principles that may be further developed into a great variety of games. Still another object is to provide, as a first in such a new family of games, a fairly well known game which uses established principles, so that players may use their presently existing skills in a new environment, which will in turn lead them to accept still newer and, as yet, unfamiliar games.

Thus, an object is to provide a means for introducing entirely new concepts into games using boundry layers.

In keeping with an aspect of the invention, these and other objects are accomplished by providing a plenum or air chamber separated by internal walls forming slots, holes or the like. The separated chambers may be either in gas pressure communication with, or entirely separated from each other. Game piece manipulation devices project upwardly through the slots or holes. The upper surface of the plenum is perforated to form the boundry layer at the playing surface. The perforations may be made in any of several different forms in order to establish different zones of surface friction. For example, the perforations may have different diameters; or, they may have pressure control orifices which the players control during play.

The nature of a preferred embodiment of the game may be understood from a study of the attached drawings, wherein.

Figure 1:
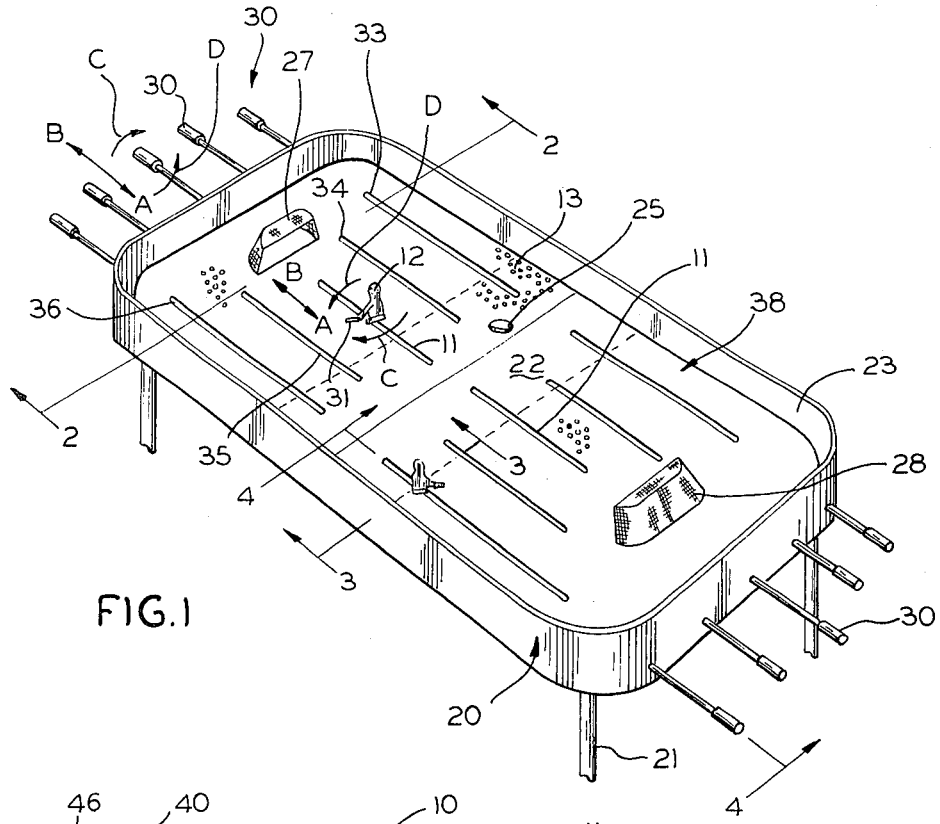
FIG. 1 is a perspective view of a playing table incorporating a preferred embodiment of the invention.

Briefly, the invention used a plenum or air chamber 10 separated by internal walls to form slots, holes or the like, (as at 11) which pierce the entire chamber. The separated chambers of plenum 10 may be either in gas pressure communication with each other or entirely separated from each other. Game piece manipulation devices project up through the slots or holes 11 to operate a puck controller 12.

The upper surface of the plenum 10 is perforated (as at 13) to form the boundry layer of air at the playing surface. If desire, the perforations may be of graduated diameter (as in FIG. 7) to form different zones of surface friction. The perforations may also have a pressure control orifice (as in FIG. 8) so that the players may selectively control surface friction during play.

In greater detail, the game device 20 (FIG. 1) may be supported in any suitable manner and at any convenient height. As here shown, the device comprises a table supported on any suitable number of legs 21. The device 20 comprises a playing surface 22 having a periphery surrounded by upstanding walls 23, which may be lined with rubber bumpers, or any other suitable surface, for deflecting the puck back onto the surface 22. The playing piece 25 may be any suitable disc-shaped object which tends to be supported by the boundry layer of air. A goal 27, 28 is provided on each of the opposite ends of the playing surface 22. The nature of these goals is irrelevant. They are here shown as being back stops, similar to an ice hockey net. They could also be holes in the table (as in pool), lines on the surface (as in shuffleboard), or the like.

Each player is provided with any suitable number of manually operated game piece manipulation devices 30. For example, there may be a handle mounted on the end of a rod which may be pushed or pulled in either of the two directions A or B, or rotated in either of the two directions C or D. Each of these game piece manipulation devices is attached to a puck controller, here shown as a small statuette of an ice hockey player 12 holding a hockey stick 31. However, other puck controllers may also include any other suitable devices, such as kickers, flippers, or the like. As here shown, there are provisions at 33, 34, 11, 35, 36 for five such game piece manipulation device, and there is a similar provision at 38 on the other end of the playing surface 22.

Figure 2:
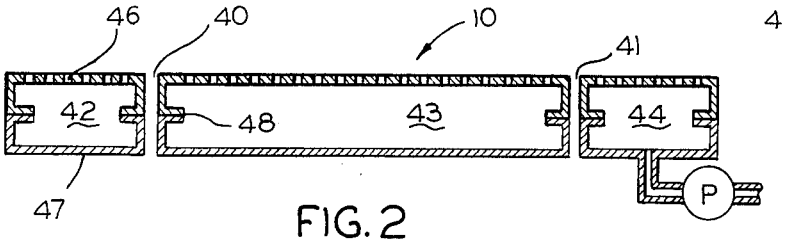
FIG. 2 is a cross section of the width of the playing table, taken along line 2—2 of FIG. 1.

The playing surface 22 is on the upper side of a plenum or air chamber which is preferably constructed as shown in FIG. 2. A mold is constructed to form one-half of a chamber in any suitable manner as by a vacuum or air pressure process. Two parts are formed in this mold and then one is inverted relative to the other. An upper one 46 of these two parts is outlined in heavily inked lines, and the lower one 47 of the two parts is outlined in lightly inkes lines for purposes of identification. The two parts are brought together and cemented in a face to face contact, to form at least one air chamber.

As here shown, internal air chamber walls at 40, 41 divide the pleneum into three separate chambers 42, 43, 44 to form the slots or holes 33, 36 (FIG. 1). These chambers 42-44 may or may not communicate with each other so that there is either one common air pressure in all chambers or three separate and controllable pressures in each of the three chambers. Any suitable form of air pump P may be provided for pressurizing the plenum. A preferred pump uses an axial, tangential impeller, with a back curved wheel. A pump of this type has excellent characteristics for pumping against a high static back pressure.

When an upper plenum section is molded, small pins are placed in the mold to perforate the finished part. When the lower plenum section is molded, these pins are pulled out avoid forming the perforations. Therefore, the resulting structure is formed as shown in FIG. 2, where the upper section 46 is shown with perforations (as at 13) and the lower section is formed without perforations. The edges of the two halves 46, 47 are all cemented together, as at 48.

The puck controller 12 comprises a base unit 51 having a shape and proportion which is adapted to slide or rotate in a recessed track 52 molded into the air chamber part 46. Preferably, the contours of base 51 are rounded to insure a smooth sliding and rotating motion. There are no corners on base 51 to catch or hang up.

Integrally depending from base 51 is a control post 53 which passes through slot 11 in the plenum. As the post 53 moves back and forth, or rotates in slot 11, the puck controller base 51 also moves back and forth, or rotates, in track 52.

A separate game piece manipulation device is provided in each of the slots 11, 33, 34, 35, 36, 38, for manually manipulating the puck controller 12. More particularly, beneath the lower half 47 of the plenum are any suitable bearings or bushings 55, 56 (FIG. 4) for slidably receiving and supporting a rod 57 leading to handle 59. A flexible spring 58 interconnects rod 57 and post 53 to translate the motions of the handle 59 through the rod 57 to the post 53. If handle 59 of the game piece manipulation device is pushed, its components rod 57, post 53, base 51 and the puck controller 12 move in direction A. If handle 59 is pulled, the rod and post of the game piece manipulation device, move in direction B. If handle 59 is rotated in direction C, puck controller 12 also rotates in direction C (FIG. 1). If handle rotation is in direction D, the puck controller rotates in direction D.

It should now be apparent that each player stands at an end assigned to him and indivudually manipulates selected ones of the handles to move an individual puck controller to a selected spot and there twirl the puck controller 12 to slap the puck.

Figure 3:
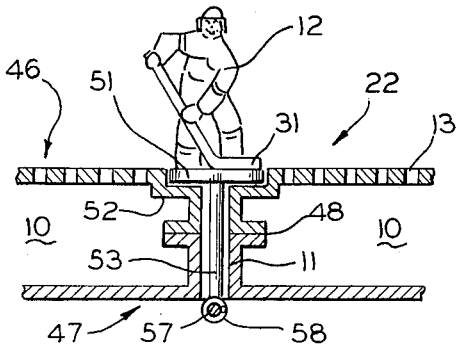
FIG. 3 is an enlarged cross sectional view taken along line 3—3 of FIG. 1 and showing how the plenum, playing surface, and game piece manipulation device are constructed.

The game piece manipulation device of FIG. 3 is a directly coupled device which provides a direct and immediate response at the puck controller 12. Other forms of game piece manipulation devices may also be provided. For example, FIGS. 5 and 6 illustrate how magnets may be used to provide different forms of linkages between the game piece manipulation devices and the puck controllers, in order to vary the demands upon the of player skill.

Figure 4:
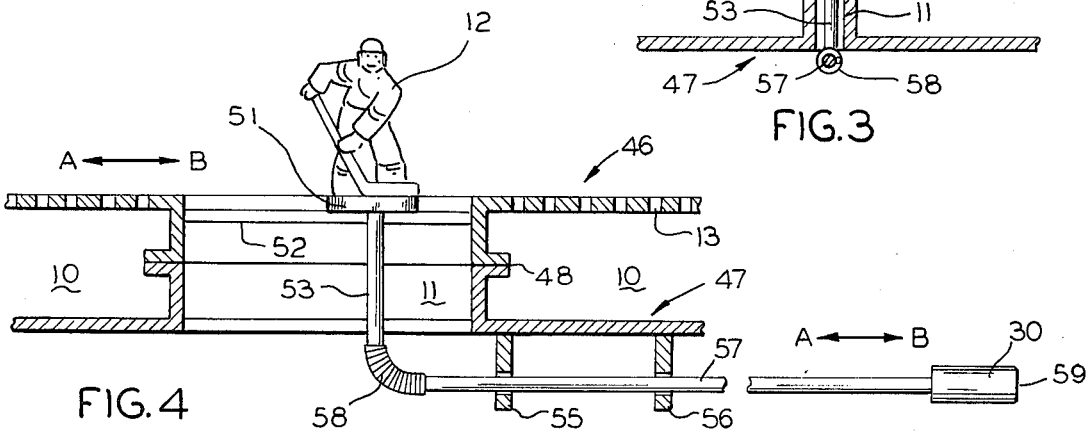
FIG. 4 is a cross section of the length of the table taken along line 4—4 of FIG. 1.
Figure 5:
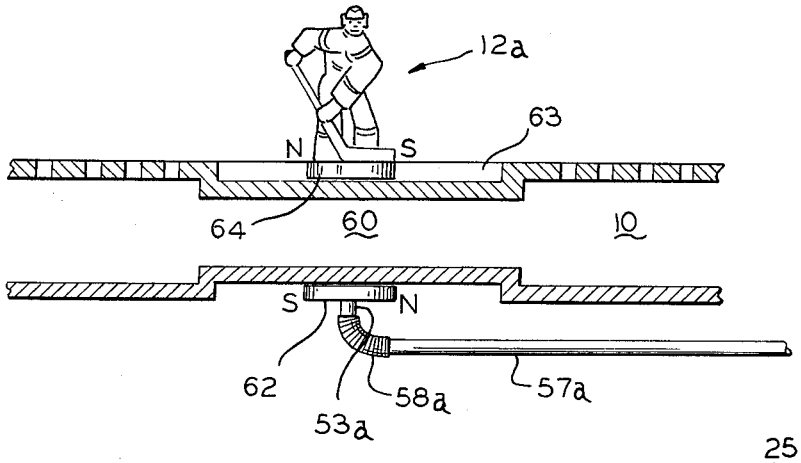
FIG. 5 is a similar cross section view wherein a game piece manipulation device involves a control by a magnet.

FIG. 5 shows a structure which is equivalent to the structure of FIG. 4, except for the substitution of a magnetic coupling for a direct mechanical coupling. More specifically, in the plenum of FIG. 5, the slot 11 is replaced by a narrow section 60 in the area below the puck controller 12*a*. A permanent magnet 62 is mounted on top of a post 53*a* controlled by rod 57*a*. The magnet 62 of FIG. 5 moves in essentially the same manner as the puck controller base 51 of FIG. 3 moves, responsive to manipulation of a handle (not shown) at the end of the rod 57*a*. Mounted in a recess 63 above the narrow section 60 is a permanent magnet 64 which carries a puck controller 12*a*. Therefore, the magnet 64 follows the movement of and rotates with the magnet 62 to move puck controller 12*a* in a similar manner. The two magnets 62, 64 are preferably bar magnets which are polarized longitudinally, as shown by the letters "N" and "S" in FIG. 5. However, an electromagnet may be substituted for permanent magnet 62 so that the forces coupling magnets 62, 64 may be varied relative to each other.

Figure 6:
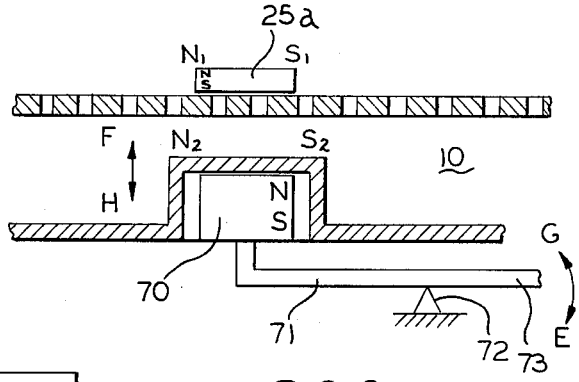
FIG. 6 is a view similar to FIG. 5 wherein the puck is controlled by a magnetic field.

FIG. 6 shows another principle wherein the puck 25*a* is a permanent magnet. Beneath the table, a permanent magnet 70 is arranged to provide a variable field. As here shown symbolically, magnet 70 is attached to an end of a shaft 71, mounted on a pivot point 72. When shaft end 73 moves up in direction G, magnet 70 moves down in direction H, and away from the playing surface. Similarly, if shaft end 73 moves down in direction E, magnet 70 moves up in direction F toward the playing surface. Therefore, as puck 25*a* slides over magnet 70, there will or will not be a friction-like effect upon the puck 25*a*, depending upon the proximity between the magnets 25*a*, 70. This way, a player may either tend to drag the puck to slow it or not to drag the puck to enable it to glide further.

In one embodiment, the two magnets 25*a*, 70 are vertically polarized, as shown by the letters "N" and "S" (FIG. 6). Then, the coupling between the magnets acts only as a drag to increase frictional forces between the puck and the playing surface. If the magnets are longitudinally polarized along their lengths, as indicated by the letters "$N_1$", "$S_1$", "$N_2$", "$S_2$", there will be a tendency for the puck to be rotated, as it passes over the magnet 70. If the mounting for magnet 70 also includes a flexible motion translational coupling similar to spring 58*a*, the player may control the speed at which the magnet 70 rotates. Hence, a puck 25*a* may be given a selected amount of spin or "English", which is important to some games which may be patterned after or similar to pool, bowling, curling, or the like. The magnetic effects of the structure shown in FIG. 6 may also be varied by providing an electromagnet with a controlled field, which may also be a rotating field.

Figure 7:
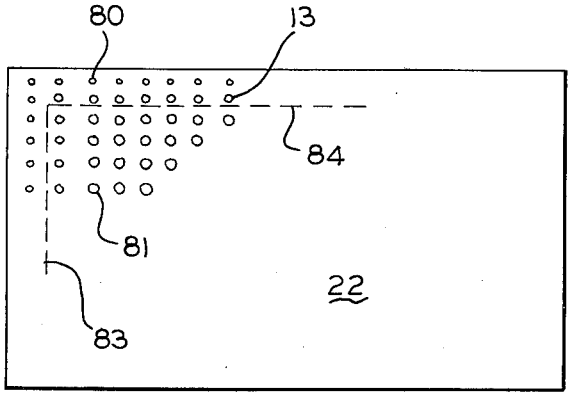
FIG. 7 is a plan view illustrating how the playing surface may be constructed to have various zones, with different friction.
Figure 8:
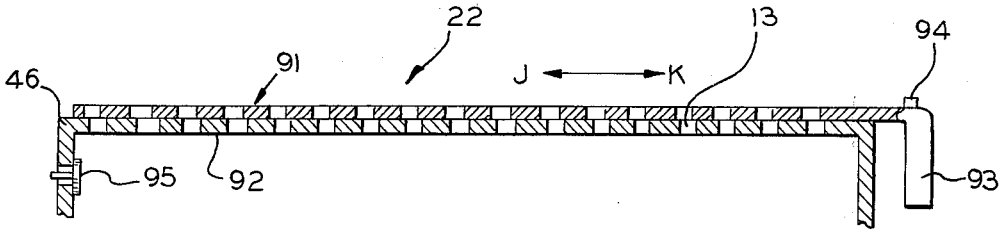
FIG. 8 schematically illustrates how the air pressure in the boundry layer may be controlled at the playing surface.

The boundry layer of air may also be controlled, in any of various different ways, two of which are shown in FIGS. 7 and 8. In greater detail, FIG. 7 shows the plan of a playing surface 22 wherein the perforations have a graduated (or different) diameter at different positions across the playing surface. Thus, a perforation 80 near the outside boundry is here shown as having a small diameter, and a perforation 81 further in toward the center of surface 22 has a larger diameter. In between, the holes have a graduated pattern of increasing diameter. Hence, there will be more surface air and less friction in the center of the playing field 22 than in the peripheral areas. Also, internal partitions 83, 84 may be provided within the plenum to establish separate air flow channels with different static air pressures. These same principles may be used in any of many different ways. For example, in a shuffleboard type of game, the perforation diameters may be selected so that the surface friction forces may become greater (or lesser) near the line where the puck is supposed to stop. In a hockey game the friction forces may be greater ahead of the goal zone, thereby tending to stop the puck short of its goal. In a similar manner, any suitable friction zoning may be provided.

FIG. 8 illustrates two other ways in which surface friction may be manually controlled. Here, the playing surface may be a large perforated sheet 91 positioned immediately above and in registry with a perforated surface 92 of a plenum chamber. Sheet 91 is mounted on any suitable support means (such as a peripheral ball bearing race, for example) to slide back and forth (in directions J, K), for small distances which tend to cover or uncover perforations (such as 13) in the plenum chamber. Thus, by pushing handle 93 in directions J or K, the amount of air (and therefore friction) above the playing surface may be varied.

Another way of reducing friction is to provide an exhaust valve 95, controlled by push button 94, for momentarily reducing plenum pressure, near at least a small area of the playing surface. Preferably, a valve 95 may be disposed to exhaust air laterally (e.g., parallel) away from the playing surface 22. If the valve 95 opens briefly (near a goal, for example) it may produce a momentary reduction of air pressure in the bound layer, especially in its immediate vicinity.

From the foregoing, it should be apparent that the invention provides means for individually controlling each of the game variables (i.e., the puck, puck controller and surface air or friction). The controls may be distributed over the playing surface in different ways (i.e., at individual spots (as in FIG. 6), along specific paths or alleys (as in FIG. 4, 5), or in zones (as in FIG. 7). The control may also provide means for giving at least some degree of "English" to the puck, and in the case of a rotating electromagnetic field, the "English" may be a precisely controlled amount of spin.

The nature of any given game will, of course, vary. One game (FIG. 1) is based on ice hockey. Other games may be based on other sports such as baseball, football, socker or the like. Still other games may be completely new ones specifically designed for exploiting the characteristics of a pressurized air table. Therefore, the rules and methods of play may vary from game to game. Hence, the foregoing description of a hockey game is given purely by way of example, and not as a limitation upon the invention.

It should now be apparent that the invention provides a very flexible apparatus for making any of a great variety of games utilizing the friction-free surface provided by a boundry layer of air. Therefore, the appended claims are to be construed to cover all equivalent structures, falling within the true scope and spirit of the invention.

I claim:

1. A game device having a horizontal playing surface, a playing piece for sliding over said surface, playing piece controller means for imparting energy and for directing the playing piece to cause it to slide, means comprising a source of air pressure for forming a boundary layer of pressurized air above at least part of said playing surface, said playing piece sliding over said boundary layer, said air pressure means comprising a completely enclosed air chamber having a perforated upper side adjacent said playing surface for discharging said boundary layer of air over said playing surface, said air chamber having walls formed therein to provide access means for enabling said playing piece controller means to be operated from points below said chamber for directing said playing piece without loss of air pressure within said chamber.

2. The device of claim 1 wherein said air chamber walls comprise internal chamber walls forming holes or slots which pierce said air chamber to provide mechanical access from below said chamber, through said chamber, and to said playing surface.

3. The device of claim 1 wherein said air chamber walls comprise a portion shaped to provide a chamber thickness which is adequately narrow to enable a completion of a magnetic coupling through said chamber, and said playing piece controller comprises a magnetic means positioned below said portion of chamber walls.

4. The device of claim 3 and means for mounting said magnetic means to slide under said chamber, said playing piece comprises a magnet sliding over said surface and adapted to be magnetically coupled to said sliding magnetic means, at least sometimes.

5. The device of claim 4 wherein said magnetic means provides a controllably rotatable magnetic field.

6. The device of claim 5 and means wherein said rotatable magnetic field imparts "English" to said playing piece, thereby causing to rotate while sliding.

7. The device of claim 1 wherein said air pressure means forms said boundary layer into different zones on said playing surface to provide zones having different degrees of friction between said playing piece and said playing surface.

8. The device of claim 7 wherein said zones are formed by perforations having different diameters whereby the boundary layer has different pressure in different zones on the playing surface.

9. The device of claim 8 wherein said perforations have diameters which are graduated over said playing surface to form said zones.

10. The device of claim 8 and means for changing the diameters of said perforations to control the amount of air in said boundary layer.

11. A game device comprising a perforated playing surface, means for forcing pressurized air through said perforations to provide a boundary layer of air over said surface, said perforations having a characteristic which may be varied to cause different amounts of the pressurized air layer to be formed over given portions of said playing surface to change the frictional forces between said surface and a playing piece sliding over said surface, and sealed channels piercing said air forcing systems for forming a plurality of holes or slots, each for receiving an individually associated movable game piece manipulation device, without leaking pressurized air into the pierced channels.

12. The device of claim 11 wherein each of said game piece manipulation devices comprises a movable horizontal rod connected to a vertical post via a flexible coiled spring, whereby said post may be slid or rotated, within said sealed channel, responsive to a manipulation of said rod.

* * * * *